United States Patent [19]

Maude

[11] 4,032,099

[45] June 28, 1977

[54] RECLINER PLATFORM

[76] Inventor: James Walton Maude, 52 Village St., Marblehead, Mass. 01945

[22] Filed: Feb. 9, 1976

[21] Appl. No.: 656,815

[52] U.S. Cl. ..... 248/188.2; 248/397; 248/351; 297/325

[51] Int. Cl.[2] ..... A45D 19/04; A47C 1/02

[58] Field of Search ..... 248/1, 2, 19, 188.1, 248/188.2, 188.3, 351, 346, 371, 397, 398, 499, 500, 501, 505, 74; 297/310, 325, 328, 313, 345, 463

[56] References Cited

UNITED STATES PATENTS

| | | | |
|---|---|---|---|
| 92,758 | 7/1869 | Smith | 297/325 X |
| 1,251,649 | 1/1918 | Enholm | 297/325 X |
| 1,375,337 | 4/1921 | Wagner | 297/270 |
| 2,040,942 | 5/1936 | Katenkamp | 297/325 X |
| 2,149,195 | 2/1939 | Strickler | 248/188.2 |
| 2,325,716 | 8/1943 | Streit | 297/325 X |
| 2,431,589 | 11/1947 | Shuler | 248/346 UX |
| 2,661,172 | 12/1953 | Needham | 248/19 |
| 2,857,707 | 10/1958 | Caioli | 248/188.3 |
| 2,936,992 | 5/1960 | Browning | 248/499 |
| 3,462,804 | 8/1969 | Renaudin | 248/74 R X |

FOREIGN PATENTS OR APPLICATIONS

| | | | |
|---|---|---|---|
| 62,164 | 4/1944 | Denmark | 297/325 |
| 69,725 | 7/1947 | Denmark | 248/188.2 |
| 1,477,777 | 3/1967 | France | 248/74 R |
| 1,131,413 | 10/1956 | France | 248/74 R |
| 767,060 | 4/1934 | France | 248/19 |
| 797,130 | 6/1958 | United Kingdom | 248/346 |

*Primary Examiner*—Lawrence J. Staab

[57] ABSTRACT

A platform structure for raising and supporting the front edge of the seat section of any piece of furniture that is used for seating or lounging. The platform is so designed that, without mechanical activity, it will automatically properly position itself under the said piece of furniture by merely manually raising the front edge of the seat section. With the platform in its supporting posture, the resting apparatus is positioned into a comfortable reclining attitude. Whenever it is desired to reset the seat section to a level position, the platform can be swung easily into a location that no longer elevates said seat section. When deposited into this inactive location, the platform has been placed, still attached, in a safe area until further use of it is desired.

1 Claim, 8 Drawing Figures

RECLINER PLATFORM

SUMMARY OF THE INVENTION

The present invention relates to a platform structure, and specifically to a novel and simple creation thereof that is strong, low in cost, durable, and pleasing in appearance.

One of the primary objects of my invention is to provide a novel platform wherein the structure may be so positioned that the attitude of the seat section of a piece of furniture may be maintained in its level position, yet can be easily tilted, and supported by said platform, into a comfortable reclining posture, without mechanical activity.

Another object of this invention is to provide a novel platform that creates and supports a comfortable reclining tilt to the seat section of a piece of furniture, yet can be easily repositioned to restore the said seat section to a level attitude without mechanical activity.

Also, an object of this invention is to provide a novel platform that can be positioned easily into a "self storing" location whenever the leveling of the seat section of the resting apparatus is desired.

In addition, an object of this invention is to provide a novel platform that remains attached, in a safe place, to the resting apparatus when said platform is not being used to tilt the seat section of said apparatus.

A still further object of this invention is to provide a novel platform that, while in its safely stored location, always remains in position to be reset to a state that tilts the resting apparatus into the reclining posture without any mechanical activity.

It is also an object of this invention to provide a novel platform that is attachable to an appropriate piece of furniture, without the use of a tool of any kind.

Other objects, advantages, and features of the present invention will be made more apparent as this description proceeds. The construction of one embodiment of my invention is well illustrated in the accompanying drawings, wherein.

Throughout the several figures of the drawings, I have employed the same character of reference to indicate similar parts.

DETAILED DESCRIPTION

The recliner platform apparatus I am about to describe, and constitute as one embodiment of my invention, is well illustrated in various views and positions in FIGS. 1, 5, 6, 7, and 8.

Figures 7, 8:
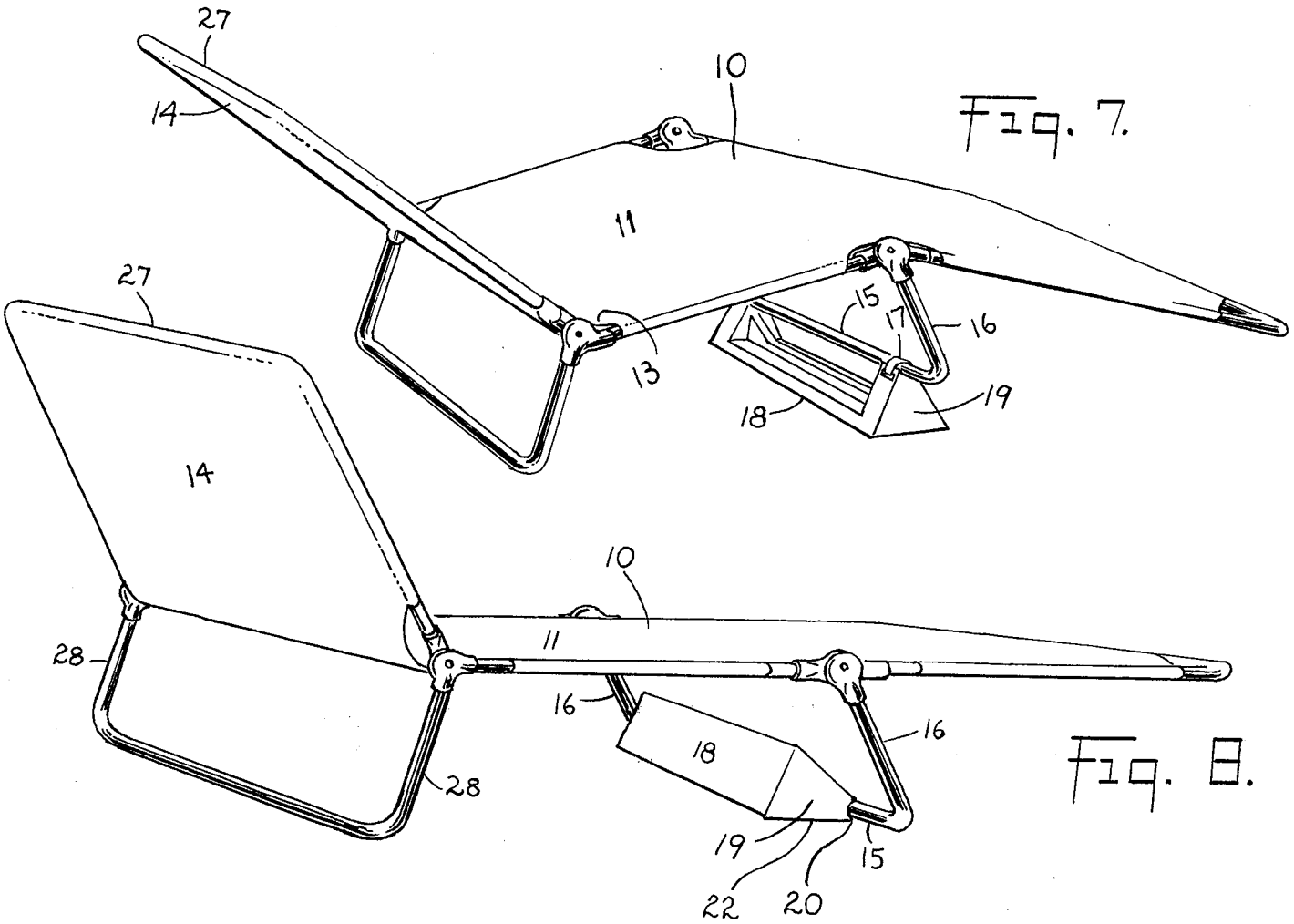
FIG. 7 is a perspective view of the platform in the active position of supporting the front edge of the seat section of a unit of furniture.
FIG. 8 is a perspective view of the platform in the inactive position of not supporting any section of a unit of furniture and illustrating how it is stored in a safe location.

With reference to FIGS. 7 and 8, it is often desirable, and to some individuals, much more comfortable when resting on a piece of furniture, to be able to assume what, hereafter in this specification, is referred to as a "reclining position". For the purposes of this specification the term, reclining position, is one where the front edge 10 of the seat section 11 of the resting apparatus is higher than the back edge 13, and it follows that when in this position, the back support 14 of the unit of furniture will assume a lower angle away from that of vertical. Described in different words, when a person is resting on a piece of furniture in what I call the normal or level position, the hips and knees of the individual are extended on a horizontal plane. In contrast to this normal position, if the apparatus is changed to permit the user to assume the reclining position, I am inferring that the apparatus has now attained an attitude that has its seat section 11 tilted in a manner whereby the knees are higher than the hips and the person's back is allowed to lay further away from the more normal upright plane. FIG. 7 is an illustration of how the back 14 and seat section 11 of a unit of furniture may appear when I mention the reclining position, while FIG. 8 illustrates an example of the back 14 and seat section 11 attitudes when I allude to the normal position.

Figure 3:
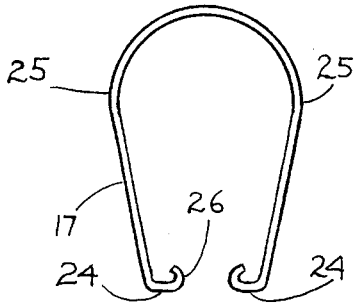
FIG. 3 is a front view of a retaining clip subassembly.
Figure 4:
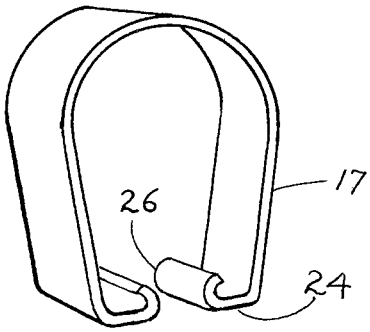
FIG. 4 is a perspective view of a retaining clip subassembly.

My invention is a platform apparatus that gives a unit of furniture that is used for seating or lounging, the ability to repose in either the normal position or be changed to a posture that allows the user to rest in a reclining position. The platform can be utilized on any resting type furniture that contains, in its design, a supporting or reinforcing member 15 that passes between the two front legs 16 of the seat section 11. This reinforcing member 15 is commonly found, for example, on currently popular lawn furniture that is constructed by using tubular metal frames. This is not to infer, in any way, that my invention is necessarily limited to furniture of this type of construction. Insofar as simplicity of structure is concerned, the present invention is composed of three subassemblies, to wit, the platform, and two retaining clips 17 that are illustrated in FIGS. 3 and 4. The ease of assemblability of the structure of my invention, which results in its attachment to the resting apparatus, derives in part from the simplicity of the structure and also in large part from the fact that the three subassemblies can be fit together in a novel and advantageous manner without the need of any tool.

Figure 1:
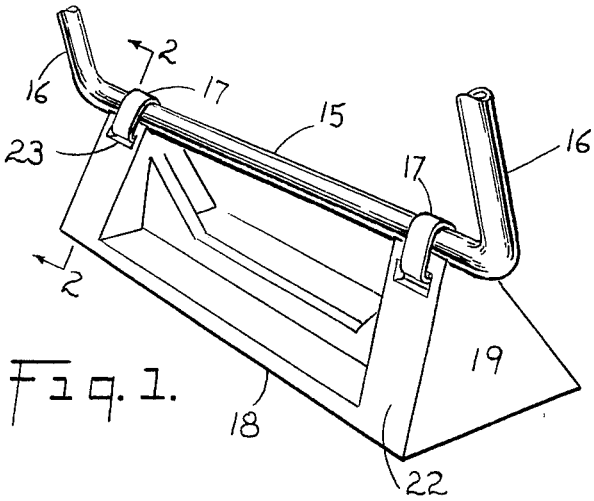
FIG. 1 is a perspective view of this platform attached to a fragmentary portion of the front legs of the seat section of a lounge as shown in complete detail within FIG. 7.

The platform is preferably constructed by a single molding of structural material such as hard plastic, using common molding techniques known throughout the plastics industry. However, I wish it to be understood that the manufacture of this staging is not limited to the exact materials and construction methods herein described. FIGS. 7 and 8 illustrates an application of the present invention when used on furniture that is constructed by using tubular metal frames. FIG. 1 shows a fragmentary portion of the two front legs 16 of the seat section 11 with the reinforcing member 15 passing between them, and the platform positioned under the reinforcing member 15 so as to place the seat section 11 of the unit of furniture in the reclining posture as illustrated in FIG. 7. FIG. 8 shows that two front legs 16 of the seat section 11 and the reinforcing member 15 when the platform is placed in its stored position which results in the seat section 11 of the rest apparatus in its normal or level position.

Figure 2:
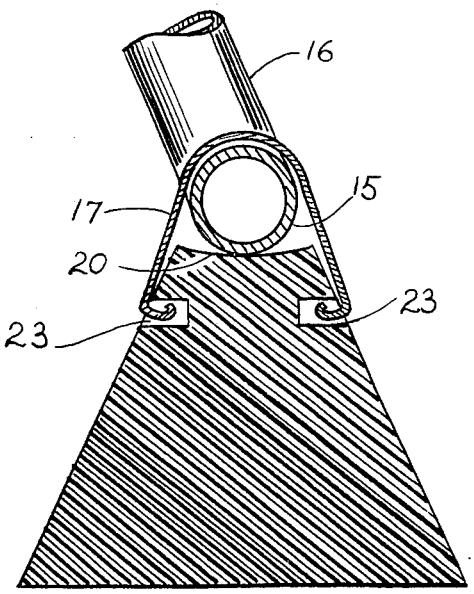
FIG. 2 is a sectional view taken substantially on the line 2—2 of FIG. 1.
Figure 5:
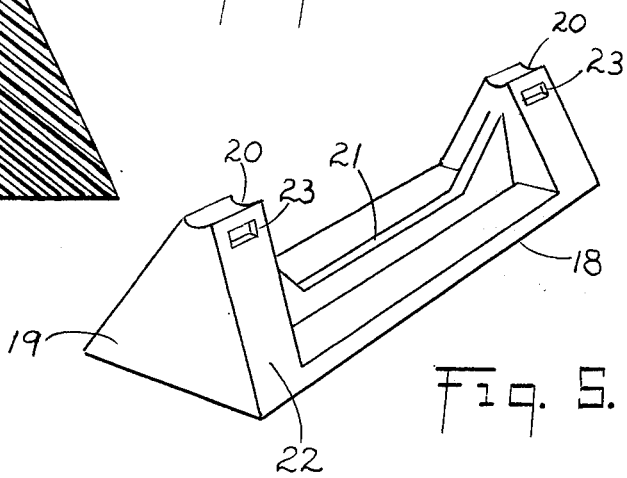
FIG. 5 is a perspective view of the unattached platform.
Figure 6:
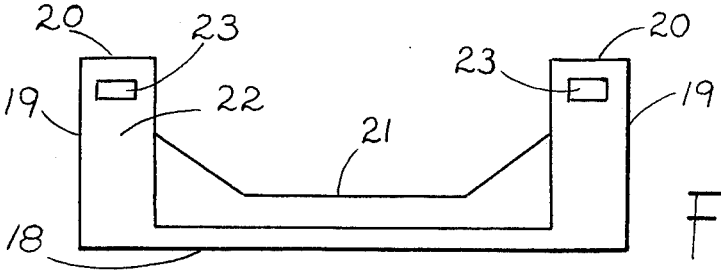
FIG. 6 is a front view of the unattached platform.

I will now describe in detail, just the platform subassembly alone as shown in FIGS. 5 and 6. Integral with the bottom base plate 18 of the platform, are sides 19 at either end, which incline to the heads 20 of the platform. The sides 19 and base plate 18 may with advantage, be centrally stiffened by a rib 21. If the single unit molding method is utilized, this supporting rib 21 would of course be in the design of the mold and a strong and durable staging would result. The heads 20 of the sides 19 may be flat across the top or they could follow the contour of the load as shown in FIG. 2. It is on these heads 20 that the reinforcing member 15 rests when the platform is employed to place the unit of furniture into the reclining position as illustrated in FIG. 7.

The sides 19 of the platform also contain in their slanting edges 22, and in close proximity to the heads 20, a hole or a horizontal slot 23 as shown in FIGS. 1, 2, 5, or 6. The purpose of these cavities is explained in the next paragraph which describes in detail the other two subassemblies of my invention.

One of the main objects, advantages, and features of my invention, is the extremely simple method of attaching and holding the platform to the unit of furniture. For the purposes of this document I will refer to the two subassemblies that accomplish this connection, as retaining clips 17. FIGS. 3 and 4 illustrate their appearance when they are in their unattached mode. These retaining clips 17 are made from narrow strips of metal that are formed as shown in FIGS. 3 and 4, and tempered to a degree of hardness and elasticity that will allow the tabs 24 to be spread far enough apart so as to pass by the width of the reinforcing member 15 and then, because of their temper, slip along the slanted edges of the sides 22 of the platform until said tabs 24 snap securely into the horizontal slots 23 provided. FIG. 2 illustrates a retaining clip 17 after it has been placed in this position and accomplishes attachment of the platform to the unit of furniture. When the retaining clips 17 are correctly placed in position, they are to fit loose enough around the reinforcing member 15 so as to just allow the platform to swing freely whenever it is suspended and not bearing the weight of the furniture. FIG. 3 shows that a retaining clip 17 in its inactive state, is shaped such that the distance between the tips of its tabs 24 is less than the greatest width of the retaining clip 17 which is at point 25. Thus, it follows, that because in their manufacture the retaining clips 17 are tempered, their tabs 24 when placed in their attaching posture will be kept forced into the horizontal slots 23 provided on the platform and preserve the connection to the unit of furniture. To fulfill one of the objects of my invention whereby this attachment can be easily made without the use of any tool, it need only be insured, during the manufacture of the retaining clip 17, that a degree of hardness and elasticity be such that even the limited strength of a child be enough to spread the tabs 24 of the retaining clip 17 far enough apart to permit proper connection of my invention. The formation and tempering strength processes are common knowledge to the associated industry and it can easily construct such subassemblies as herein described. The purpose of curling the metal at the tip of the tab 26 is to provide a smoother edge on the retaining clip 17 as it slides down to the horizontal slots 23 in the platform. From a consideration of the foregoing, it will be appreciated that these retaining clips 17 are not complicated in the least, and can be readily and cheaply made, as from stamped sheet metal.

Having completed a description of a specific embodiment of my invention, I will now explain the mode of operation. Once the reclining platform is attached, as heretofore described to a unit of furniture, the platform can be positioned in an inactive posture as shown in FIG. 8 by raising manually the front edge 10 of the seat section 11 and swinging the platform on its long axis at the heads 20 of the sides 19 and lowering the said front edge 10 so as to cause the platform to rest on its sides' edges 22. In this attitude the seat section 11 of the unit of furniture will attain a position that is parallel to the floor. To reposition the platform to one that will set the seat section 11 into a reclining attitude, it is only necessary to raise the front edge 10 of the seat section 11. When the front edge 10 is raised higher than the height of the platform's sides 19, the platform will swing from the force of gravity acting on the staging's center of gravity. As a result of the design of my invention this will cause the staging to hang suspended by the afore mentioned retaining clips 17 and automatically the platform will be positioned so as to bear the weight of the seat section in a reclining attitude. In a situation when the platform has been attached to the currently popular light-weight lawn furniture, the raising of the seat section 11 is easily accomplished by merely pressing down on the top of the back supporting section 27, which results in the seat section's 11 front edge 10 rising as the rear legs 28 bear the weight of the entire unit. Once in its active posture, as illustrated in FIG. 7, the platform can often (if not on a slippery surface) be replaced into its safely stored inactive position by merely pushing the furniture slightly forward until the platform, in a manner of speaking, "rolls" under the seat section 11.

Having now described the preferred embodiment of my invention, I claim as new, and desire to secure by Letters Patent, the following, together with such modifications as may be made by one skilled in the art. While I have shown and described a special arrangement of my invention as used with tubular frame furniture, this is by way of illustration only and does not constitute any sort of limitation on my invention as various changes, alterations, omissions, additions, deviations, and departures may be made in the embodiment shown without avoiding the claims hereinafter.

What is claimed:

1. A platform for elevating and supporting the front leg portion of a piece of furniture having a seat section, comprising a base plate, side members rigidly attached at opposite ends of said base plate, each of said side members having upwardly inclined, converging surface portions rising from said base plate and terminating in a support surface, said support surface being smoothly contoured to fit the shape of said front leg portion, each of said inclined surface portions having a cavity located therein adjacent its respective support surface, and each of said members further including a spring tempered retaining clip having off-set tabs received in the cavities of said side members, said support surface and said retaining clip receiving said front leg portion;

whereby said platform will automatically properly position itself under the front leg portion when the piece of furniture is manually raised, said platform being movable to an inactive position wherein the front leg portion is no longer elevated.

* * * * *